United States Patent [19]

El-Sayed et al.

[11] Patent Number: 4,985,329

[45] Date of Patent: Jan. 15, 1991

[54] BIPOLAR LIQUID ELECTROSTATIC DEVELOPER

[75] Inventors: Lyla M. El-Sayed, West Chester, Pa.; Sanford M. Marcus, Wilmington; Torence J. Trout, Yorklyn, both of Del.

[73] Assignee: E. I. du Pont de Nemours and Company, Wilmington, Del.

[21] Appl. No.: 292,573

[22] Filed: Dec. 30, 1988

[51] Int. Cl.[5] ..... G03G 9/135

[52] U.S. Cl. ..... 430/115; 430/126

[58] Field of Search ..... 430/112, 114, 115, 126, 430/45

[56] References Cited

U.S. PATENT DOCUMENTS

| | | | |
|---|---|---|---|
| 3,078,231 | 2/1963 | Metcalfe et al. | 430/114 |
| 3,615,398 | 10/1971 | Caldwell | 430/126 X |
| 4,068,938 | 1/1978 | Robertson . | |
| 4,078,929 | 3/1978 | Gundlach . | |
| 4,264,185 | 4/1981 | Ohta . | |
| 4,500,616 | 2/1985 | Haneda et al. | 430/45 |
| 4,524,117 | 6/1985 | Maekawa et al. | 430/45 |
| 4,663,264 | 5/1987 | Mitchell | 430/115 |
| 4,702,984 | 10/1987 | El-Sayed et al. | 430/115 |
| 4,702,985 | 10/1987 | Larson | 430/115 |
| 4,707,429 | 11/1987 | Trout | 430/115 |
| 4,780,389 | 11/1988 | El-Sayed | 430/115 |
| 4,804,603 | 2/1989 | Liston | 430/126 |
| 4,830,945 | 5/1989 | Wong et al. | 430/114 |
| 4,877,698 | 10/1989 | Watson et al. | 430/45 |
| 4,880,720 | 11/1989 | Drappel et al. | 430/115 |

FOREIGN PATENT DOCUMENTS

| | | | |
|---|---|---|---|
| 1225049 | 12/1957 | Fed. Rep. of Germany | 430/115 |

*Primary Examiner*—Roland Martin

[57] ABSTRACT

Bipolar liquid electrostatic developer consisting essentially of at least one charge director in a nonpolar liquid having dispersed therein two toner particles having opposite charge polarity which comprise at least one thermoplastic copolymer resin. The particle average by area size is less than 10 μm. The ratio of the two toner particles is 5 to 95 and 95 to 5. A process of simultaneous transfer of such developer is included. The developer is useful in copying.

22 Claims, No Drawings

BIPOLAR LIQUID ELECTROSTATIC DEVELOPER

TECHNICAL FIELD

This invention relates to a bipolar electrostatic developer. More particularly this invention relates to a bipolar liquid electrostatic developer containing at least one charge director in a nonpolar liquid in which is dispersed two oppositely charged thermoplastic resin particles. This invention also relates to a process for simultaneous transfer of the bipolar liquid electrostatic developer from a chargeable surface to a receptor support to form a two-color image.

BACKGROUND OF THE INVENTION

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size as measured by a Horiba CAPA-500 centrifugal automatic particle analyzer After the latent electrostatic image has been formed, the image is developed by the colored toner particles dispersed in said nonpolar liquid and the image may subsequently be transferred to a carrier sheet. Developed images of two or more colors can be prepared by creating successive, single color light images, successively recording these images on the photoconductive surface, developing the photoconductive surface with liquid electrostatic developer containing colored toner particles complementary in color to the color light image, and transferring to a carrier sheet or receptor support each developed image in either superimposed registration or in non-overlapping relation to its preceding transferred image. This type of process using liquid electrostatic developer is time-consuming because of the many steps involved and registration or location of the transferred images can be a problem.

In many instances only two-color images are desired. While these can be of any possible color combination, frequently the colored images desired by business are black and red. Dry toners or developers consisting of two colored pigments such as black and red have been mixed together and applied either successively or simultaneously to a conductive surface and subsequently transferred to a receptor support. Dry toner combinations rely mainly on their placement in the triboelectric series for their particular charge. Such dry toner compositions have certain disadvantages relative to liquid electrostatic developers, e.g., low resolution due to larger particle size, less suitable for high speed copying due to slower development times, limited color gamut and limited colors due to difficult pigment dependent charging, and difficult removal of background toner. However, the use of known liquid electrostatic developers presents other disadvantages, e.g., inability to mix color toners of any color without cross color contamination, inability to mix different liquid toners with different charge polarity, and inability to control charging independent of pigment.

It is desired to provide a bipolar liquid electrostatic developer which can overcome the aforementioned disadvantages.

SUMMARY OF THE INVENTION

In accordance with this invention there is provided a bipolar liquid electrostatic developer consisting essentially of at least one soluble charge director present in a nonpolar liquid having dispersed therein two toner particles having opposite charge polarity which comprise at least one thermoplastic copolymer resin, the two toner particles having an average by area particle size of less than 10 μm and being present in a ratio of 5 to 95 and 95 to 5.

In accordance with an embodiment of this invention there is provided a process for the simultaneous transfer of bipolar liquid electrostatic developer from a developed surface to a receptor support of different potential, the bipolar liquid electrostatic developer consisting essentially of at least one charge director present in a nonpolar liquid having dispersed therein two toner particles having opposite charge polarity which comprise thermoplastic resin copolymers, the oppositely charged particles having an average by area particle size of less than 10 μm present in a ratio of 5 to 95 and 95 to 5, the transfer process comprising (a) developing latent images having positive and negative potential by applying the bipolar liquid electrostatic developer whereby the negatively charged developer particles adhere to the image of positive potential and the positively charged developer particles adhere to the image of negative potential to give a developed surface; (b) changing the charge polarity of one of the developers on the developed surface so that the charge polarity of both developers on the developed surface is the same; and (c) transferring simultaneously the developers by electrostatic means to the receptor support whereby a two component image is obtained.

In the claims appended hereto "consisting essentially of" means the composition of the liquid electrostatic developer does not exclude unspecified components which do not prevent the advantages of the developer from being realized. For example, in addition to the primary components, there can be present additional components, such as colorant, adjuvant as described more fully below, etc.

In designating an image area as positive or negative the following procedure is used. An electrostatic probe is placed above an image area and the voltage generated is recorded as referenced to the image surface ground plane. This is repeated for an area to be imaged by complementary charged developer particles. An electrode is set at an intermediate voltage value between the two. If the voltage of this electrode is lower than that of the image area, this area is designated as positive and negatively charged developer particles will be deposited. If the voltage of this electrode is higher than that of the image area, this area is designated as negative and positively charged developer particles will be deposited.

The bipolar liquid electrostatic developers of this invention differ from other liquid electrostatic developers primarily in that there are present in the developer two oppositely charged thermoplastic resin particles as defined above. We have found that developer particles as defined can be made to assume a determined polarity by changing the developer composition. The charge polarity of the toner particles can be determined by varying the resin, adjuvant, colorant(s), charge director and combinations thereof in the developer. It is preferred to control the charge polarity with choice of resin and adjuvant, e.g., certain adjuvant and resins charge positive or negative polarity with specific charge directors. Without limiting the invention, the liquid developer which consists essentially of a nonpolar liquid having dispersed therein two toner particles having opposite charge polarity and at least one charge director dissolved in the nonpolar liquid developer can contain the following variations in composition: (a) identical resin composition: at least one of the toner particles of the same polarity has an adjuvant dispersed therein. When both toner particles contain an adjuvant dispersed therein the adjuvant is different; (b) different resin compositions: toner particles can be provided with or without dispersed adjuvants. Colorant can also affect the toner charging.

Ingredients useful in the liquid electrostatic developer of this invention include the following materials: Nonpolar liquids which are, preferably, branched-chain aliphatic hydrocarbons and more particularly, Isopar®-G, Isopar®-H, Isopar®-K, Isopar®-L, and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° and 197° C., Isopar®-L between 188° C. and 206° and Isopar®-M between 207° C. and 254° C. and Isopar®-V between 254.4° C. and 329.4° C. Isopar®-L has a mid-boiling point of approximately 194° C. Isopar®-M has a flash point of 80° and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp. (°C.) |
|---|---|---|
| Norpar® 12 | 69 | 204 |
| Norpar® 13 | 93 | 210 |
| Norpar® 15 | 118 | 210 |

All of the nonpolar liquids have an electrical volume resistivity in excess of $10^9$ ohm centimeters and dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred nonpolar liquids, the essential characteristics of all suitable nonpolar liquids are the electrical volume resistivity and the dielectric constant. In addition, a feature of the nonpolar liquids is a low Kauri-butanol value less than 30, preferably in the vicinity of 27 or 28, determined by ASTM D 1133. In the preparation of liquid developer the ratio of thermoplastic resin to nonpolar liquid is such that the combination of ingredients becomes fluid at the working temperature. The nonpolar liquid is present in an amount of 85 to 99.9% by weight, preferably 97 to 99.5% by weight, based on the total weight of liquid developer. The total weight of solids in the liquid developer is 0.1 to 15%, preferably 0.5 to 3.0% by weight. The total weight of solids in the liquid developer is solely based on the ingredients described more fully below such as the resin, including components dispersed therein, e.g., pigment component, adjuvant, etc.

Useful thermoplastic resins or polymers include: ethylene vinyl acetate (EVA) copolymers (Elvax® resins, E. I. du Pont de Nemours and Company, Wilmington, DE), copolymers of ethylene and an $\alpha,\beta$-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline), ethylene ethyl acrylate series sold under the trademark Bakelite® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn® ionomer resin by E. I. du-Pont de-Nemours and Company, Wilmington, DE, etc., or blends thereof, polyesters, polyvinyl toluene, polyamides, styrene/-butadiene copolymers and epoxy resins, thermoplastic resin selected from the group consisting of an ethylene copolymer having a carboxylic acid substituent and copolymer of ethylene and at least one other monomer having a carboxylic acid substituent, the acid substituent being modified into a substituent selected from the group consisting of an ester, said ester having substituents selected from the group consisting of hydroxyl, carboxyl, amine and alkyl of at least one carbon atom: amide and acid halide.

Preferred negative resins are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid number of the copolymers range from 1 to 120, preferably 54 to 90. Acid no. is milligrams potassium hydroxide required to neutralize 1 gram of polymer. The melt index (g/10 min) of 10 to 500 is determined by ASTM D 1238 Procedure A. Other preferred negative resins include the blended resins disclosed in Larson and Trout U.S. Pat. No. 4,772,528 issued Sept. 20, 1988, the disclosure of which is incorporated herein by reference. A particularly preferred copolymer is prepared from ethylene (89%)/methacrylic acid (11%) wherein the acid no. is 66 and the melt index is 100 at 190° C. Preferred positive resins include acrylic resins, such as a copolymer of acrylic or methacrylic acid (optional but preferred) and at least one alkyl ester of acrylic or methacrylic acid wherein alkyl is 1–20 carbon atoms, e.g., methyl acrylate (50–90%)/methacrylic acid (0–20%)/ethyl hexyl acrylate (10–50%), and other acrylic resins including Elvacite Acrylic resins, E. I. du Pont de Nemours & Company, Wilmington, DE, or blends of the resins, polystyrene; polyethylene; and modified resins disclosed in El-Sayed, Mitchell, Schmidt and Trout U.S.S.N. 07/080,669 filed Aug. 3, 1987, now U.S. Pat. No. 4,798,778, the disclosure of which is incorporated herein by reference. A particularly preferred copolymer is a terpolymer of methylacrylate (67.3%)/methacrylic acid (3.1%)/ethyl hexyl acrylate (29.6%), no. ave. mol. wt. is about 172,000 (osmometry techniques) and acid no. is 13.

The thermoplastic resins described above optionally can have dispersed therein a colorant and adjuvants. Negative adjuvants include: metallic soaps described in Trout, U.S. Pat. Nos. 4,707,429 and 4,740,444 issued Nov. 17, 1987 and Apr. 26, 1988 respectively, inorganic metal salts described in El-Sayed, U.S. Pat. No. 4,758,494 issued July 19, 1988; hydroxy acids described in Trout, U.S.S.N. 027,612 filed Mar. 17, 1987, now U.S. Pat. No. 4,859,559; etc., disclosures of which are incorporated herein by reference. Positive adjuvants include: organic sulfur-containing compounds described in USSN 07/292,291, filed Dec. 30, 1988, now U.S. Pat. No. 4,917,985, "Organic Sulfur-Containing Compounds as Adjuvants for Positive Electrostatic Liquid Developers"; phosphorous-containing compounds described in USSN 07/292,191, filed Dec. 30, 1988, now U.S. Pat. No. 4,917,986, entitled "Phosphorous-Containing Compounds as Adjuvants for Positive Electrostatic Liquid Developers"; and aromatic nitrogen-containing compounds described in USSN 07/292,192, filed Dec. 30, 1988, entitled "Aromatic Nitrogen-Containing Compounds as Adjuvants for Electrostatic Liquid Developers". These applications are filed concurrently herewith and are incorporated herein by reference.

In addition, the resins have the following preferred characteristics:

1. Be able to disperse the adjuvant, metallic soap, colorant, e.g., pigment, etc.

2. Be substantially insoluble in the dispersant liquid at temperatures below 40° C., so that the thermoplastic resin will not dissolve or solvate in storage, 3. Be able to solvate at temperatures above 50° C.

4. Be able to form particles between 0.1 μm and 5 μm, in diameter (preferred size), e.g., determined by Horiba CAPA-500 centrifugal particle analyzer; and between about 1 μm and 15 μm, in diameter, e.g., determined by Malvern 3600E Particle Sizer as described below.

5. Be able to form a particle (average by area) of less than 10 μm, e.g., determined by Horiba CAPA-500 centrifugal automatic particle analyzer, and, about 30 μm average particle size, e.g., determined by Malvern 3600E Particle Sizer as described below.

6. Be able to fuse at temperatures in excess of 70° C. By solvation in 3. above, the resins forming the toner particles will become swollen or gelatinous.

As indicated above the toner particles in the developer have an average particle size of less than about 30 μm, preferably less than about 15 μm, as measured using a Malvern 3600E particle sizer described more fully below. Various instruments are known to measure the particle size. One such instrument is a Horiba CAPA-500 centrifugal particle analyzer, manufactured by Horiba Instruments, Inc., Irvine, CA. In determining particle size by area, solvent viscosity of 1.24 cps, solvent density of 0.76 g/cc, sample density of 1.32 using a centrifugal rotation of 1,000 rpm, a particle size by area range of 0.01 to less than 10 μm, and a particle size by area cut 1.0 μm are used. Another instrument for measuring average particle sizes is a Malvern 3600E Particle Sizer manufactured by Malvern, Southborough, MA which uses laser diffraction light scattering of stirred samples to determine average particle sizes. Since these instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Horiba instrument.

Nonpolar liquid soluble ionic or zwitterionic charge director compounds are generally used in an amount of 0.2 to 1500 mg/g, preferably 2.5 to 400 mg/g developer solids. Suitable negative charge director compounds include: lecithin, Basic Calcium Petronate®, Basic Barium Petronate®, Neutral Barium Petronate® oil-soluble petroleum sulfonate, manufactured by Sonneborn Division of Witco Chemical Corp., New York, NY, etc. Suitable positive charge directors include: sodium dioctylsulfosuccinate (manufactured by American Cyanamid Co.), ionic charge directors such as zirconium octoate, copper oleate, iron naphthenate, etc., nonionic charge directors such as polyethylene glycol sorbitan stearate, as well as nigrosine and triphenyl methane type dyes and Emphos®D70-30C and Emphos®F27-85, two commercial products sold by Witco Chem. Co., NY, NY, which are sodium salts of phosphated mono- and diglycerides with unsaturated and saturated acid substituents, respectively. Also useful are glyceride type charge directors which may impart a positive or negative charge to the developer depending on the resin, pigment, and/or adjuvant used. Suitable glyceride type charge directors are disclosed in Chan, El-Sayed, Trout and Thanawalla U.S. application Ser. No. 125,503, filed Nov. 25, 1987, entitled "Glycerides as Charge Directors for Liquid Electrostatic Developers," the disclosure of which is incorporated herewith by reference. Charging of the resin particles in the liquid developer is achieved using common or compatible charge directors.

As indicated above, colorants when present are dispersed in the toner particles. The developer of this invention preferably has two different colors present. Colorants, such as pigment(s) or dye(s) and combinations thereof, are preferably present to render the latent image visible. The colorant, e.g., a pigment or mixture of pigments, may be present in the amount of up to about 60 percent by weight based on the total weight of developer solids, preferably 0.01 to 30% by weight based on the total weight of developer solids. The amount of colorant may vary depending on the use of the developer. Examples of pigments are Monastral® Blue G (C.I. Pigment Blue 15 C.I. No. 74160), Toluidine Red Y (C.I. Pigment Red 3), Quindo® Magenta (Pigment Red 122), Indo® Brilliant Scarlet (Pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741), Toluidine Yellow G (C.I. Pigment Yellow 1), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Sterling NS N 774 (Pigment Black 7, C.I. No. 77266), etc.

Other ingredients may be added to the liquid electrostatic developer, such as fine particle size oxides, e.g., silica, alumina, titania, etc.; preferably in the order of 0.5 μm or less can be dispersed into the liquefied resin. These oxides, can be used in combination with the colorant. Metal particles can also be added as can magnetic particles.

Another additional component of the liquid electrostatic developer is an adjuvant soluble in the nonpolar liquid which can be selected from the group consisting of polybutylene succinimide, alkylhydroxybenzylpolyamine, and aromatic hydrocarbon having a Kauributanol value of greater than 30. The adjuvants are generally used in an amount of 1 to 1000 mg/g, preferably 1 to 200 mg/g developer solids. Examples of the various above-described adjuvants include:

polybutylene succinimide: OLOA®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.;

alkylhydroxybenzylpolyamine compounds of the formula:

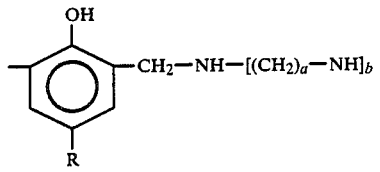

wherein a is 2–8, b is 1–10, and

R is an alkyl group of 1–20,000 carbon atoms, and being soluble in nonpolar liquid.

The above benzyl amine groups (—PN—) are connected by methylene groups to form compounds such as H—PN—$CH_2$—PN—H, H—PN—$CH_2$—NP—H, H—PN—$CH_2$—NP—$CH_2$—PN—H, and the like.

It is preferred that at least some of the R groups have 50 or more carbon atoms. The hydroxy or amine of the alkylhydroxybenzylpolyamine can be further modified. For example, boron halides such as boron trifluoride, boron triiodide and boron trichloride can form an interaction product with the phenolic hydroxy groups, i.e., hydroxy group substituents on a benzene ring. Boron oxide, boron oxide hydrate, boron trifluoride, boron triiodide, boron tribromide, boron trichloride, boric acid, boronic acids (such as alkyl-B—$(OH)_2$ and aryl—B—$(OH)_2$), tetraboric acid, metaboric acid and esters of boric acids can form interaction products with other polar groups such as primary and secondary amino (—$NH_2$ and —NH) groups as well as phenolic hydroxy groups. Suitable such copolymers are commercially available compounds, e.g., copolymers sold by Amoco Petroleum Additives Co., Clayton, MO which may differ in molecular weight. Amoco 9250 which is said to have a number average molecular weight in the range of 1600 to 1800 (determined by osmometry) and is made by reacting a polybutene with a phenol to give an alkylphenol which is reacted with a polyamine and an aldehyde. Amoco 595, and Amoco 9250 which are believed to be made by a process similar to the one used to make Amoco 9040, described above. Amoco 595 (sold as 45% surfactant, 30% aromatic hydrocarbon, and oil) and Amoco 9250 (sold as 40—45% surfactant, 36% aromatic hydrocarbon, and oil) have number average molecular weights of about 1000 and 1600 to 1800, respectively. The number average molecular weights can be determined by known osmometry techniques.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic® 100 which is a mixture of $C_9$ and $C_{10}$ alkyl-substituted benzenes manufactured by Exxon Corp., etc.

The bipolar liquid electrostatic developers of the invention can be prepared by mixing two individually prepared liquid developers each containing a single type resin particle. The two resins are present in the developer in a ratio of 5 to 95 and 95 to 5, preferably 25 to 75 and 75 to 25, based on the total weight of resin and any material dispersed therein. The individual developers can be made by various processes including but without limitation to those disclosed in Larson U.S. Pat. No. 4,760,009 and Trout U.S. Pat. No. 4,740,444, the disclosures of which are incorporated herein by reference. The type of toner particles present in the individual developers that are mixed must be capable of forming a charge opposite to that of its companion toner particles. The developer charging is accomplished either by using a common charge director in each liquid developer wherein the resin particles are of a different composition, e.g., as shown in the Examples below or a different charge director is present in each liquid developer but the charge directors are compatible with one another. The individual developers can be mixed and then the toner particles can be charged in an opposite mode. It is also possible to charge the individual toner particles present in a developer prior to mixing provided that one individual toner particle is charged opposite to that of the other individual toner particle.

The presence of the bipolar toner particles in the liquid electrostatic developer of this invention permits the development of positive and negative latent image potentials formed on a surface, e.g., photopolymer, selenium and its alloys, cadmium sulfide and its alloys, silver halide-based electrostatic printing master, organic photoconductors, dielectric surfaces, etc., to produce good quality solid area coverage with good resolution and toning of fine details.

By way of illustration the method used to image a chargeable substrate is to uniformly charge the substrate, e.g., selenium, and then image different areas with light at three different intensity levels causing the charged areas to decay at different rates. These rates are monotonic with illumination level, resulting in a surface having imaged areas with different levels of charge associated with them. When a counter electrode is placed opposite this surface and biased at the potential of the median illuminated areas the toning characteristics are: the area at the same potential as the counter electrode will not tone, the area at a higher potential will tone with negative toner and the area at a lower potential will tone with positive toner. Other methods of charging and discharging can be used, e.g., charge the surface digitally with charges of the same sign with differing density, or of different sign; use a layer of a photopolymerizable composition with the characteristic that its resistance changes as a function of illumination fixing its discharge rate in different areas. As is known the negatively charged particles adhere to the latent image having a positive potential and the positively charged particles adhere to the latent image having a negative potential.

After the polarity of either of the developers on the developed surface is changed to correspond to the polarity of the other developer, the two-component image is electrostatically transferred to a receptor support, such as paper, for the preparation of proof. Other substrates include: polymeric film, or cloth. For making integrated circuit boards, the transfer surface can be an insulating board on which conductive circuit lines can be printed by this process, or it can be an insulating board covered with a conductor (e.g., a fiber glass board covered with a copper layer) on which a resist is printed by this process. The positive and negative latent image potentials on the surface to be developed (receptor support) can be generated by corona discharge, ionography, discharge of capacitor, etc. The latent images having the negative or positive potential are developed by applying the bipolar liquid electrostatic developer of this invention to the surface thereof. This is accomplished by any method known to those skilled in the art. The polarity of one of the two toner particles of the developer is changed to make the polarity of both toner particles the same on the imaged areas. For example, the charge polarity of the developer on the developed surface having a positive charge or negative charge can be changed by negative corona and positive corona, respectively. Subsequently the images which now have the same charge are transferred to a receptor surface, e.g., of the type described above. Transfer is accomplished by electrostatic or other means, e.g., by contact with an adhesive receptor surface or applying pressure and heat. Electrostatic transfer can be accomplished in any known manner, e.g., by placing the paper in contact with the toned image using a tackdown roll or corona which cause the two surfaces to press together assuring intimate contact. After tackdown, one applies a positive corona discharge of the proper polarity to the backside of paper driving the toner particles off the electrostatic master onto the paper. It is preferred to transfer the image without a master-paper gap greater than about 6 μm.

INDUSTRIAL APPLICABILITY

The liquid electrostatic developers of this invention contain two oppositely charged electrostatic toner particles generally containing different colors. The two-colored image produced has good quality solid area coverage as well as resolution and toning of fine details independent of charge director and pigment present. The bipolar developers are useful in copying, i.e., office copy and other imaging systems utilizing highlight color copying. By means of a single or multiple pass imaging process the two types of particles of the developer are separated by electrostatic means, the particles having a positive charge polarity being attracted to negatively charged areas and the particles having a negative charge polarity being attracted to positively charged areas. The polarity of the particles is then made the same and the images formed are transferred to a receptor support.

EXAMPLES

The following examples illustrate but do not limit the invention wherein the percentages and parts are by weight.

The number average molecular weight can be determined by known osmometry techniques. Weight average molecular weights are determined by gel permeation chromatography (GPC).

Melt indices can be determined by ASTM D 1238, Procedure A.

The acid number is milligrams potassium hydroxide required to neutralize 1 gram of polymer.

The average particle sizes were determined by a Malvern 3600 Particle Sizer (Malvern, Southborough, MA or a Horiba CAPA-500 centrifugal particle analyzer (by area) as described above.

Image quality was determined on a Savin 870 copier mechanically modified by adding a pretransfer corona and removing the anodized layer from the surface of the reverse roll while simultaneously decreasing the diameter of the roll spacers by the same amount to maintain the gap between the roll and photoconductor.

Electrical modifications to the copier include:

(a) disconnecting the image density feedback loop from the development electrode and connecting the electrode to a Keithly high voltage supply (model 247), (b) connecting a Keithly high voltage supply (model 247) to the modified reverse roll, and (c) disconnecting the transfer corona and connecting same to a Trek (model 610) high voltage supply.

The modified Savin 870 was used to evaluate bipolar developers set out below and to generate color highlight copies. The procedure for generating highlight color copying is:

(a) fill the toning station with a bipolar developer mixture, (b) bias the development electrode to a positive voltage, optimally near 600v, (c) bias the pretransfer corona optimally near plus or minus 4.5 kV, (d) bias the reverse roll positive or negative, optimally near 750v (sign is dependent on the bipolar component giving background), (e) bias the transfer corona negative, optimally near 7 kV, with opposite sign from that of the pretransfer corona whereby the image to be copied consists of a grey background (density optimally near 0.3), and white and black imaged areas, is placed in the normal copy position, and copy is initiated.

PRINCIPAL OF OPERATION

The photoconductor is charged positive (near 1000v) by means of the charging corona. The copy is imaged onto this photoconductor inducing discharge to lower voltages (in order of increasing discharge-black areas, grey background, white areas). When adjacent to the development electrode the photoconductor has fields at its surface such that positive developer particles will deposit at the white imaged areas, negative developer particles at the black imaged areas and minor deposit at the grey imaged areas (as the 500v development electrode is opposite 0, 1000 and 500v respectively). Background caused by one of the charged developer particles depositing is cleaned up by the biased reverse roll. The pretransfer corona then simultaneously sprays the deposited developer and the photoconductor with a positive charge reversing the charge on the negative developer particle species.

Both developer particles are then simultaneously transferred to paper at the transfer corona position (the transfer force due to the negative charge sprayed on the back of the paper). The developed image is then thermally fused.

DEVELOPER 1

Negative Black

The following ingredients were placed in a 30 S Attritor, Union Process Company, Akron, Ohio:

| Ingredients | Amount (lbs.) |
|---|---|
| Copolymer of ethylene (89%) and methacrylic acid (11%) melt index at 190° C. is 100, acid no. is 66 | 13.2 |
| Heucophthal Blue G XBT-583D, Heubach, Inc., Newark, NJ | 0.17 |
| Sterling NS, Cabot Corp., Boston, MA | 3.14 |
| Aluminum tristearate #132, Witco Chem. Corp., NY, NY | 0.17 |
| Isopar ®-L, nonpolar liquid having a Kauri-butanol value of 27, Exxon Corporation | 106.0 |

The ingredients were heated to 100° C. +/−10° C. and milled at a rotor speed of 100 rpm with 0.01875 inch (4.76 mm) diameter carbon steel balls for one hour. The attritor was cooled to room temperature while the milling was continued. Milling was continued at a rotor speed of 330 rpm for 24 hours to obtain developer particles with an average Malvern particle size 6.8 μm. The particulate media were removed and the developer was diluted to 2% solids with additional Isopar ®-L and charged with 40 mg Basic Barium Petronate ®/g of developer solids.

DEVELOPER 2

Positive Cyan

The following ingredients were placed in a Union Process 1S Attritor, Union Process Company, Akron, Ohio:

| Ingredients | Amount (lbs.) |
|---|---|
| Copolymer of ethylene (89%) and methacrylic acid (11%): melt index at 190° C. is 100, acid no. is 66 | 200.00 |
| Heucophthal Blue G XBT-583D, Heubach, Inc., Newark, NJ | 51.28 |
| p-Toluenesulfonic acid, Fisher Scientific, Pittsburgh, PA | 5.13 |
| Isopar ®-L, described in Developer 1 | 1000.0 |

The ingredients were heated to 90° C. to 110° C. and milled at a rotor speed of 230 rpm with 0.1875 inch (4.76 mm) diameter stainless steel balls for 2 hours. The attritor was cooled to 42° C. to 50° C. while milling was continued and then 700 grams of Isopar ®-L were added. Milling was continued and the average particle size was monitored. Particle size measured with the Malvern was 4.0 μm corresponding to a 17 hour cold grind. The particulate media were removed and the developer was diluted to 2% solids with additional Isopar ®-L and charged with 40 mg Basic Barium Petronate ®/g of developer solids resulting in conductivity of 9 pmhos/cm.

DEVELOPER 3

Positive Cyan

The procedure of Developer 2 was repeated with the following exceptions: 5.13 grams of polyphosphoric acid, Aldrich Chemical Co., Milwaukee, WI, were used instead of the p-toluenesulfonic acid. The developer was cold ground for 15.5 hours and the final average particle size measured with the Malvern was 4.2 μm. The developer was diluted to 2% solids with additional Isopar ®-L and charged with 40 mg Basic Barium Petronate ®/g of developer solids resulting in conductivity of 12 pmhos/cm.

DEVELOPER 4

Positive Cyan

The procedure of Developer 2 was repeated with the following exceptions: 15.05 grams of Heucophthal Blue G XBT-583D were used instead of 51.28 grams and no p-toluenesulfonic acid was used. The developer was cold ground for 23 hours and the final average particle size measured with the Malvern was 4.0 μm. The developer was diluted to 2% solids with additional Isopar ®-L and charged with 200 mg Emphos ®D70-30C, sodium salt of phosphated monoglyceride with acid substituents, Witco Chem. Corp., NY, NY/g of developer solids resulting in conductivity of 29 pmhos/cm.

DEVELOPER 5

Positive Black

The procedure of Developer 2 was repeated with the following exceptions: 0.07 gram of Heucophthal Blue G XBT-583D was used instead of 51.28 grams and 35 grams of Sterling NS black pigment, Cabot Corp., were also used. In addition, 2.4 g of Witco Aluminum Stearate S was used in place of the p-toluenesulfonic acid. 1700 grams of Isopar ®-L were added initially instead of in two additions. The developer was cold ground for 17 hours with final average Malvern particle size of 5.3 μm. The developer was diluted to 2% solids with additional Isopar®-L and charged with 125 mg Emphos®D70-30C described in Developer 4/g of developer solids resulting in conductivity of 17 pmhos/cm.

DEVELOPER 6

Positive Cyan

The following ingredients were placed in a Union Process 01 Attritor, Union Process Company, Akron, Ohio:

| Ingredients | Amount (lbs.) |
|---|---|
| Terpolymer of methyl acrylate (67.3%)/methacrylic acid (3.1%)/ and ethylhexyl acrylate (29.6%), weight average molecular weight of 172,000, acid no. is 13 | 40.00 |
| Heucophthal Blue G XBT-583D, Heubach, Inc., Newark, NJ | 10.26 |
| p-Toluenesulfonic acid, Fisher Scientific, Pittsburgh, PA | 1.03 |
| Isopar ®-L, described in Developer 1 | 125.00 |

The ingredients were heated to 90° to 110° and milled with 0.1875 inch (4.76 mm) diameter stainless steel balls for 2 hours. The attritor was cooled to 42° to 50° while milling was continued. Milling was continued for 23 hours and the average Malvern particle size was 4.7 μm. the particulate media were removed and the dispersion of developer particles was then diluted to 2% solids with additional Isopar®-L and a charge director such as Emphos®D70-30C described in Developer 4 was added, in an amount of 166 mg/g of developer solids, resulting in conductivity of 30 pmhos/cm.

DEVELOPER 7

Negative Black

The procedure of Developer 5 was repeated with the following exceptions: 0.6 g Heucophthal Blue G XBT-583D was used instead of 0.7 g, 27 g of Sterling NS black pigment was used instead of 35 g, and 2.2 g of Witco aluminum stearate S was used instead of 2.4 g, and the developer was cold ground for 17 hours with a final average Malvern particle size of 4.7 μm. The developer was diluted to 2% solids with additional Isopar®-L and charged with 51.4 mg Basic Barium Petronate®/g of developer solids resulting in conductivity of 30 pmhos/cm.

DEVELOPER 8

Positive, Unpigmented

The procedure of developer 2 was repeated with the following exceptions: no p-toluenesulfonic acid and no pigment were used, and 200 grams of a terpolymer of methyl acrylate (67.3%)/methacrylic acid (3.1%)/and ethylhexyl acrylate (29.6%) weight average molecular weight of 172,000, acid no. is 13 were used. The developer was hot ground for 1.5 hours and cold ground for 20.5 hours with final average particle size of 6.5 μm. The developer was diluted to 2% solids with additional Isopar®-L and charged with 200 mg Exphos®D709-30C described in Developer 4/g of developer solids resulting in conductivity of 20 pmhos/cm.

DEVELOPER 9

Negative Unpigmented

The procedure of Developer 6 was repeated with the following exceptions: no p-toluene sulfonic acid and no pigment were used, and 40 grams of a copolymer of ethylene (89%)/methacrylic acid (11%) were used instead of the terpolymer described in Developer 6. Toner was cold ground for 22.5 hours with final average Malvern particle size of 8.1 μm. The developer was diluted to 2% solids with additional Isopar®-L and charged with 200 mg Emphos®D70-30C described in Developer 4/g of developer solids resulting in conductivity of 20 pmhos/cm.

DEVELOPER 10

Positive Cyan

The procedure of Developer 2 was repeated with the following exceptions: the developer was cold ground for 23 hours. The developer was diluted to 2% solids with additional Isopar®-L and mixed with Developer 11 described below. The mixture of Developers 10 and 11 was charged with 40 mg Basic Barium Petronate®/g of developer solids resulting in conductivity of 17 pmhos/cm.

DEVELOPER 11

Negative Black

The procedure of Developer 1 was repeated with the following exceptions: the following amounts of materials were used: 15.7 lbs of the copolymer, 2.75 lbs of Sterling NS Black pigment, 0.06 lb of the cyan pigment, 0.19 lb of Aluminum tristearate, Nuodex Inc., Piscataway, NJ, and 43 lbs of Isopar®-L. The materials were heated and milled for 0.5 hour. The developer was cold ground for 6 hours with final average Malvern particle size of 9.3 μm. The developer was diluted to 2% solids with additional Isopar®-L and mixed with Developer 10 described above. The mixture was charged with 40 mg Basic Barium Petronate®/g of developer solids resulting in conductivity of 17 pmhos/cm.

DEVELOPER 12

Positive Black

The following ingredients were placed in a 30 S Attritor, Union Process Company, Akron, Ohio:

| Ingredients | Amount (lbs.) |
|---|---|
| Copolymer described in Developer 6 | 17.5 |
| Uhlich BK-8200, black pigment, Paul Uhlich Co., Inc., Hastings-On-Hudson, NY | 3.5 |
| Isopar ®-L, described in Developer 1 | 100.0 |

The ingredients were heated to 100° C. +/−10° and milled at a rotor speed of 100 rpm with 0.01875 inch (4.76 mm) diameter carbon steel balls for 2.5 hours. The attritor was cooled to room temperature while the milling was continued at a rotor speed of 330 rpm for 17 hours. Three 6.25 lb. aliquots of a 10% solution of Amoco 9040 alkylhydroxypolyamine in Isopar®-L were added to the attritor at 4 hours, 6 hours, and 8 hours into the cold grind. The final developer particles had an average Horiba particle size of 0.85 μm. The developer was diluted to 2% solids with additional Isopar®-L and charged with 200 mg Emphos®D70-30C described in Developer 4/g of developer solids resulting in conductivity of 55 pmhos/cm.

DEVELOPER 13

Negative Magenta

The procedure of Developer 2 was repeated with the following exceptions: 200 grams of a copolymer of ethylene (91%) and methacrylic acid (9%), melt index at 190° C. is 500, acid no. 54, were used instead of the copolymer in Developer 2. Instead of the cyan pigment, 58.1 grams of Mobay R6700 and 10.3 grams of Mobay R6713 magenta pigments, Mobay Chemical Corp., Haledon, NJ were used. In addition 5.5 grams of aluminum tristearate, Witco Chem. Co., NY, NY were also used. 1700 grams of Isopar®-L were added initially instead of two additions. The developer was hot dispersed for 1 hour and cold ground for 4.5 hours with final Malvern average particle size of 5.3 μm. The developer was diluted to 1.5% solids with additional Isopar®-L and charged with 70 mg Basic Barium Petronate®/g of developer solids resulting in conductivity of 26 pmhos/cm.

EXAMPLE 1

Bipolar Mix of Developers 1 and 2

Developers 1 and 2 were mixed at two levels of 25/75 and 50/50. The 50/50 bipolar mix was run in the modified Savin 870 copier described above with +600V development bias, −4.0 kV pretransfer corona, and +7.0 kV transfer corona. Image and transfer quality were good. The 25/75 mix was run with +400V development bias, −4.5 kV pretransfer corona, and +7.0 kV transfer corona. Image and transfer quality were also good and the density of the cyan image was increased.

EXAMPLE 2

Bipolar Mix of Developers 1 and 3

Developers 1 and 3 were mixed 25/75 and evaluated in the modified Savin 870 copier with +250V development bias, −5.0 kV pretransfer corona, and +9.0 kV transfer corona. Image and transfer quality were

EXAMPLE 3

Bipolar Mix of developers 4 and 5

Developers 4 and 5 were mixed 50/50 and evaluated in the modified Savin 870 copier with +5.00V development bias, −4.0 kV pretransfer corona, and +7.0 kV transfer corona. In addition, a 750V bias was applied to the reverse roll. Image and transfer quality were good. The use of the reverse roll bias improved image quality by lowering developer background.

EXAMPLE 4

Bipolar Mix of Developers 6 and 7

Developers 6 and 7 were mixed 50/50 and evaluated in the modified Savin 870 copier with +600V development bias, −4.0 kV pretransfer corona, +7.0 kV transfer corona and +750V reverse roll bias. Image and transfer quality were good.

EXAMPLE 5

Bipolar Mix of Developers 8 and 9

Developers 8 and 9 were mixed 50/50 and evaluated in the modified Savin 870 copier. Images were run with 3 different voltage settings to tone and transfer the positive developer particles, the negative developer particles, and both developer particles together. To develop images with the positive developer particles, a positive developer target was used with the following biases: +600V development bias, −6 kV transfer corona and no pretransfer corona or reverse roll bias. This gave an image for an unpigmented positive developer with no background. To develop images with the negative developer particles, a negative developer target was used and the transfer corona was changed to +6 kV. This gave an image for an unpigmented negative developer with no background. To develop images with both developer particles in a single pass, a bipolar developer target was used with the following biases: +600V development bias, and +4 kV pretransfer corona, −6.0 kV transfer corona and 750V reverse roll bias. Image and transfer quality were good.

EXAMPLE 6

Bipolar Mix of Developers 10 and 11

Developers 10 and 11, were mixed 50/50, and then charged and evaluated in the modified Savin 870 copier with two different sets of voltages. First, +600V development bias, +4.0 kV pretransfer corona, and −7.0 kV transfer corona, and 750V Reverse Roll bias were used. With these voltages the black developer particles were changed from negative to positive and transferred with the positively charged cyan particles. Image and transfer quality were good. Next, +600V development bias, −4.0 kV pretransfer corona, and +7.0 kV transfer corona and 750 V Reverse Roll bias were used. With these voltages the cyan developer particles were changed from positive to negative and transferred with the negatively charged black developer particles. Image and transfer quality were good.

EXAMPLE 7

Bipolar Mix of Developers 12 and 13

Developers 12 and 13 were mixed 50/50 and evaluated in the modified Savin 870 copier with +600V development bias, −4.0 kV pretransfer corona, +7.0 kV transfer corona, and +750V reverse roll bias. Image and transfer quality were good. This example shows that bipolar developers can be made with magenta pigments, two charge directors, and a positively charged black developer.

We claim:

1. A bipolar liquid electrostatic developer consisting essentially of two compatible soluble charge directors present in a nonpolar liquid having dispersed therein two toner particles having opposite charge polarity which comprise at least one thermoplastic copolymer resin, the two toner charged particles having an average by area particle size of less than 10 μm and being present in a ratio of 5 to 95 and 95 to 5.

2. A bipolar liquid electrostatic developer according to claim 1 wherein the resin is a copolymer of ethylene and an $\alpha,\beta$-ethylenically unsaturated acid selected from the group consisting of acrylic acid and methacrylic acid.

3. A bipolar liquid electrostatic developer according to claim 3 wherein the resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

4. A bipolar liquid electrostatic developer according to claim 3 wherein the thermoplastic resin is a copolymer of ethylene (89%)/methacrylic acid (11%) having a melt index at 190° C. of 100 the percentages being by weight percent of the copolymer.

5. A bipolar liquid electrostatic developer according to claim 1 wherein the resin is a terpolymer of methyl acrylate/methacrylic acid/ethylhexyl acrylate.

6. A bipolar liquid electrostatic developer according to claim 1 wherein each resin particle contains dispersed therein one of two colorants present in the developer in an amount up to 60% by weight based on the total weight of developer solids.

7. A bipolar liquid electrostatic developer according to claim 6 wherein the colorant is a pigment or mixture of pigments.

8. A bipolar liquid electrostatic developer according to claim 6 wherein the colorant is a dye or mixture of dyes.

9. A bipolar liquid electrostatic developer according to claim 1 wherein at least one charge director is an oil-soluble petroleum sulfonate.

10. A bipolar liquid electrostatic developer according to claim 1 wherein at least one charge director is a sodium salt of phosphated monoglyceride with acid substituents.

11. A bipolar liquid electrostatic developer according to claim 6 wherein the resin is a copolymer of ethylene (89%)/methacrylic acid (11%) having a melt index at 190° C. of 100.

12. A bipolar liquid electrostatic developer according to claim 6 containing an adjuvant selected from the group consisting of polybutylene succinimide, alkylhydroxybenzylpolyamine inorganic metal salt, metallic soap, aromatic hydrocarbon, hydroxy acid, organic sulfur-containing compounds, phosphorous-containing compounds, and aromatic nitrogen-containing compounds with the proviso that when the inorganic metal salt, metallic soap, organic sulfur-containing compound, phosphorous-containing compound, or aromatic-nitrogen containing compound is present, each is dispersed in the thermoplastic resin particle.

13. A bipolar liquid electrostatic developer according to claim 12 wherein the thermoplastic resin particles have dispersed therein a metallic soap.

14. A bipolar liquid electrostatic developer according to claim 13 wherein the metallic soap is aluminum tristearate.

15. A bipolar liquid electrostatic developer according to claim 13 wherein the metallic soap is present in 0.01 to 60% by weight based on the total weight of solids.

16. A bipolar liquid electrostatic developer according to claim 1 wherein the toner particles have an average particle size of less than 5 $\mu$m.

17. A bipolar liquid electrostatic developer according to claim 12 wherein the resin particles have dispersed therein an organic sulfur-containing compound.

18. A bipolar liquid electrostatic developer according to claim 17 wherein the organic sulfur-containing compound is p-toluenesulfonic acid.

19. A bipolar liquid electrostatic developer according to claim 14 wherein p-toluenesulfonic acid is also present dispersed in the resin particles.

20. A bipolar liquid electrostatic developer according to claim 12 wherein the resin particles have dispersed therein polyphosphoric acid.

21. A bipolar liquid electrostatic developer according to claim 14 wherein polyphosphoric acid is also present dispersed in the resin particles.

22. A bipolar liquid electrostatic developer according to claim 1 wherein the resin particles have a plurality of fibers integrally extending therefrom.

* * * * *